US010443182B2

(12) United States Patent
Adkins et al.

(10) Patent No.: US 10,443,182 B2
(45) Date of Patent: Oct. 15, 2019

(54) CUSTOMER SELECTION OF DESIRED REMAINING MOISTURE IN CLOTHING VIA USER INTERFACE AT MACHINE OR PORTABLE ELECTRONIC DEVICE

(71) Applicant: WHIRLPOOL CORPORATION, Benton Harbor, MI (US)

(72) Inventors: Andrew Adkins, St. Joseph, MI (US); Alexander Halbleib, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 244 days.

(21) Appl. No.: 15/393,311

(22) Filed: Dec. 29, 2016

(65) Prior Publication Data

US 2018/0187366 A1 Jul. 5, 2018

(51) Int. Cl.

*D06F 58/28* (2006.01)
*D06F 39/00* (2006.01)
*D06F 58/20* (2006.01)

(52) U.S. Cl.

CPC ..... *D06F 58/28* (2013.01); *D06F 39/005* (2013.01); *D06F 58/20* (2013.01); *D06F 2058/289* (2013.01); *D06F 2058/2819* (2013.01); *D06F 2058/2854* (2013.01); *D06F 2058/2883* (2013.01); *D06F 2058/2896* (2013.01)

(58) Field of Classification Search

CPC ..... D06F 58/28; D06F 39/005; D06F 58/20; D06F 2058/2819; D06F 2058/2883; D06F 2058/289; D06F 2058/2896

USPC ..... 34/427

See application file for complete search history.

(56) References Cited

U.S. PATENT DOCUMENTS 3,071,864 A * 1/1963 Menk ..... D06F 58/28 34/527
5,546,678 A * 8/1996 Dhaemers ..... D06F 58/10 34/224
5,899,005 A * 5/1999 Chen ..... D06F 58/02 34/528

(Continued)

FOREIGN PATENT DOCUMENTS

EP 2789725 A1 10/2014

OTHER PUBLICATIONS

European Patent Office; European Search Report for European Application No. EP17208279; dated May 8, 2018; 7 pages; Munich, Germany.

*Primary Examiner* — Stephen M Gravini
(74) *Attorney, Agent, or Firm* — Price Heneveld LLP

(57) ABSTRACT

A method of controlling the clothes dryer includes offering one or more preset dryness levels that may be selected using a programmable dryness level selector to establish a drying cycle. Each of the preset dryness levels may correspond to a stored remaining moisture content. The method additionally includes sensing a remaining moisture content of a load of fabric in the clothes dryer and displaying the remaining moisture content of the load of fabric to a user. The method further includes automatically stopping the clothes dryer using a controller configured to determine when the remaining moisture content of the load of fabric reaches the selected preset dryness level. The one or more preset dryness levels may be customizable by saving a target remaining moisture content for each preset dryness level.

20 Claims, 9 Drawing Sheets

(56) References Cited

U.S. PATENT DOCUMENTS 5,940,988 A * 8/1999 Eisen ..... D06F 43/007 34/596
6,199,300 B1 * 3/2001 Heater ..... D06F 58/28 34/446
6,519,871 B2 2/2003 Gardner et al.
6,931,760 B2 * 8/2005 Yang ..... D06F 58/28 307/650
6,941,674 B2 9/2005 Park et al.
7,191,548 B2 * 3/2007 Salameh ..... D06F 58/02 34/380
7,322,126 B2 * 1/2008 Beaulac ..... D06F 58/28 34/554
7,345,491 B2 3/2008 Pezier
7,921,578 B2 * 4/2011 McAllister ..... D06F 35/00 134/10
8,201,345 B2 * 6/2012 Dalton ..... D06F 58/28 34/389
8,245,415 B2 * 8/2012 Bellinger ..... D06F 58/28 34/389
8,549,770 B2 * 10/2013 Bellinger ..... D06F 58/28 34/486
8,627,581 B2 * 1/2014 Brown ..... D06F 58/02 34/603
8,776,394 B2 * 7/2014 Catauro ..... F04D 29/281 310/63
8,875,416 B2 * 11/2014 Anderson ..... D06F 58/04 34/603
8,937,625 B2 * 1/2015 Lee ..... F26B 25/06 34/381
9,200,842 B2 12/2015 Hopkins
9,238,887 B2 1/2016 Prajescu et al.
9,359,714 B2 * 6/2016 Contarini ..... D06F 58/203
9,435,070 B2 * 9/2016 Bae ..... D06F 58/28
9,951,465 B1 * 4/2018 Herschler ..... D06F 58/28
2002/0174564 A1 11/2002 England
2002/0184789 A1 12/2002 Gardner et al.
2004/0200093 A1 10/2004 Wunderlin et al.
2005/0097773 A1 5/2005 Gardner
2010/0174668 A1 7/2010 Finch et al.
2014/0002461 A1 1/2014 Wang
2016/0053427 A1 2/2016 Noh et al.
2018/0187366 A1 * 7/2018 Adkins ..... D06F 39/005

* cited by examiner

CUSTOMER SELECTION OF DESIRED REMAINING MOISTURE IN CLOTHING VIA USER INTERFACE AT MACHINE OR PORTABLE ELECTRONIC DEVICE

FIELD OF THE DISCLOSURE

The present disclosure generally relates to clothes drying appliances, and in particular, to a clothes dryer adapted to detect and display moisture-related information.

BACKGROUND OF THE DISCLOSURE

In order to provide a user with enhanced control features for a clothes drying appliance, it may be desirable to know the moisture content of the clothing being dried. For example, the dryer can be operated until it senses that the moisture content of the clothing has reached or fallen below a desired amount. The drying cycle of the clothes dryer may then be stopped or the temperature lowered accordingly.

SUMMARY

In at least one aspect, a method of drying a load of fabric using a clothes dryer is provided. The method includes offering one or more preset dryness levels that are selectable using a programmable dryness level selector to establish a drying cycle, retrieving a stored target remaining moisture content that corresponds to the selected preset dryness level, sensing a remaining moisture content of the load of fabric in the clothes dryer, displaying the remaining moisture content of the load of fabric, and automatically stopping the clothes dryer using a controller configured to determine when the remaining moisture content of the load of fabric reaches the corresponding stored target remaining moisture content.

In at least another aspect, a method of controlling a clothes dryer is provided. The method includes offering one or more preset dryness levels selectable using a programmable dryness level selector to establish a drying cycle, storing a target remaining moisture content for at least one of the preset dryness levels, sensing a remaining moisture content of a load of fabric in the clothes dryer, displaying the remaining moisture content of the load of fabric, and automatically stopping the clothes dryer using a controller configured to determine when the remaining moisture content of the load of fabric reaches the corresponding stored target remaining moisture content.

In at least another aspect, a clothes dryer is provided. The clothes dryer includes a cabinet, a drum rotatably mounted within the cabinet for receiving a load of fabric to be dried, a display adapted to present a real time remaining moisture content for the load of fabric, a controller configured to receive information from one or more sensors and a selector to determine a length of time for a drying cycle, and a control panel coupled to the cabinet. The selector in communication with the controller includes a programmable dryness level selector, a temperature selector, and/or a cycle selector.

These and other features, advantages, and objects of the present device will be further understood and appreciated by those skilled in the art upon studying the following specification, claims, and appended drawings.

DETAILED DESCRIPTION OF EMBODIMENTS

Figure 1:
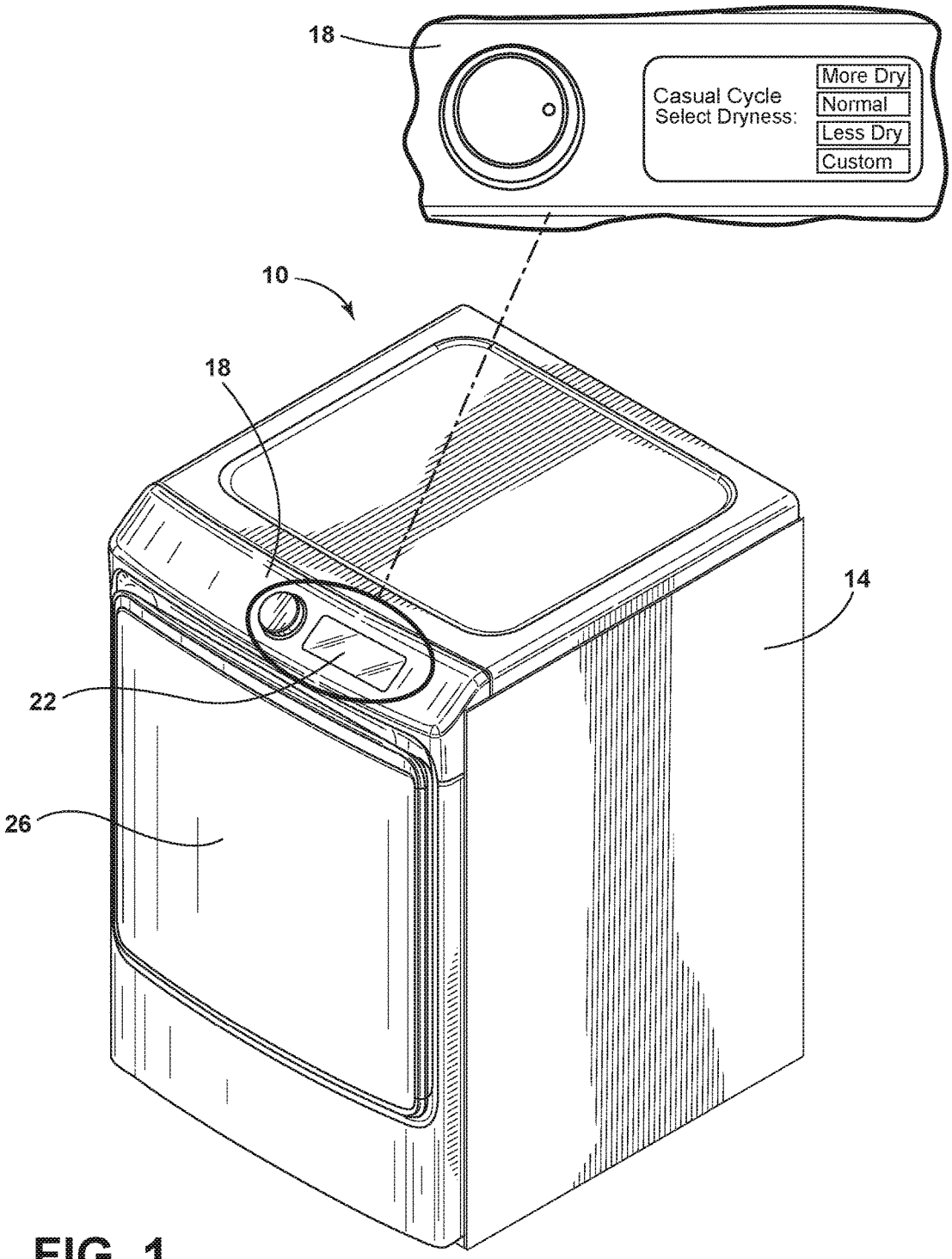
FIG. 1 is a front perspective view of a clothes dryer according to one aspect of the current disclosure.
Figure 2:
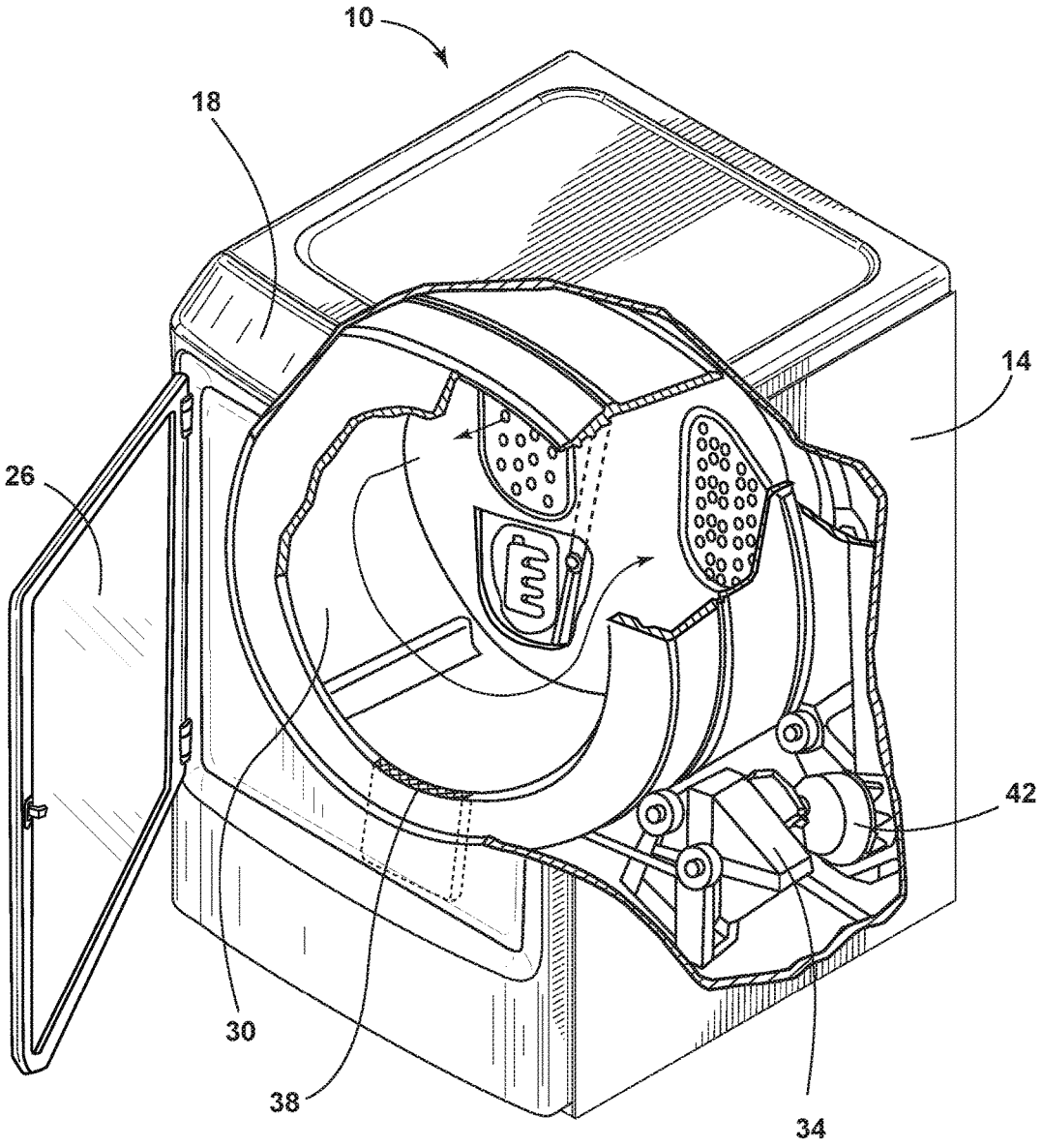
FIG. 2 is a partially cut-away perspective view of the clothes dryer of FIG. 1.

Referring to FIGS. 1-3B, the reference numeral 10 generally designates a clothes dryer. The clothes dryer 10 includes a cabinet 14 having a control panel 18 and a display 22 coupled to a portion of the cabinet 14 that can be visible and accessible to the user. The cabinet 14 includes a door 26 that is operable to access a drum 30. The interior of the clothes dryer 10 includes the drum 30 that is rotated by a motor 34 to tumble the load of fabric in the clothes dryer 10. A filter member 38 collects lint and other residual fabric material from the load of fabric being dried. A blower 42 is coupled to the interior space and the ventilation system of the clothes dryer 10 to circulate moisture and humid air out of the clothes dryer 10.

Referring again to FIGS. 1-3B, a method of controlling the clothes dryer 10 includes offering one or more preset dryness levels that may be selected using a programmable dryness level selector 50*a* (FIG. 4) to establish a drying cycle 52 as shown in the exploded portion of the display 22 in FIG. 1. Each of the preset dryness levels may correspond to a stored target remaining moisture content. The method additionally includes sensing a remaining moisture content of a load of fabric in the clothes dryer 10 and displaying the remaining moisture content of the load of fabric with the display 22. For example, FIG. 3A displays images of the display 22 at specific points over time (I-III) corresponding to the remaining moisture content of the load of fabric during the drying cycle 52. Images I-Ill visually represent when the remaining moisture content of the load of fabric is 35, 25, and 5, respectively.

Still referring to FIGS. 1-3B, the method further includes automatically stopping the clothes dryer 10 using a controller 46 configured to determine when the remaining moisture content of the load of fabric reaches the stored target remaining moisture content. The one or more preset dryness levels may be customizable by saving the target remaining moisture content that corresponds to a respective preset dryness level. For example, FIG. 3B displays several images (I-III) representing how one can use the display 22 to store the target remaining moisture content for different dry levels of a drying cycle. In some embodiments, each of the various drying cycles, (i.e. casual cycle, normal cycle, delicate cycle, etc.) may have one or more dryness levels that can each be stored with a different target remaining moisture content. For example, the various dryness levels for a given cycle may include a less dry threshold, a normal dry threshold, and/or a more dry threshold.

Remaining moisture content can be quantified in a variety of ways. In certain implementations, remaining moisture content can be quantified as a measure of the moisture content of a material, such as fabric or clothing, in equilibrium with the environment and the relative humidity of that environment. For example, in certain applications, remaining moisture content is quantified as the percent water weight remaining in a sample relative to the initial percent water weight in the sample. For example, if a wet load of fabric added to the clothes dryer 10 had 500 grams of total water being retained by the fabric, the remaining moisture content could be computed as "X" divided by 500 grams where "X" is calculated to be the total remaining amount of water retained by the saturated load of fabric at a particular point in time. This exemplary quantification approach is sometimes described within the industry as "relative moisture content" and abbreviated as "RMC." However, other approaches that measure and quantify the amount of moisture remaining with clothes are within the scope of the present disclosure.

Figure 3A:
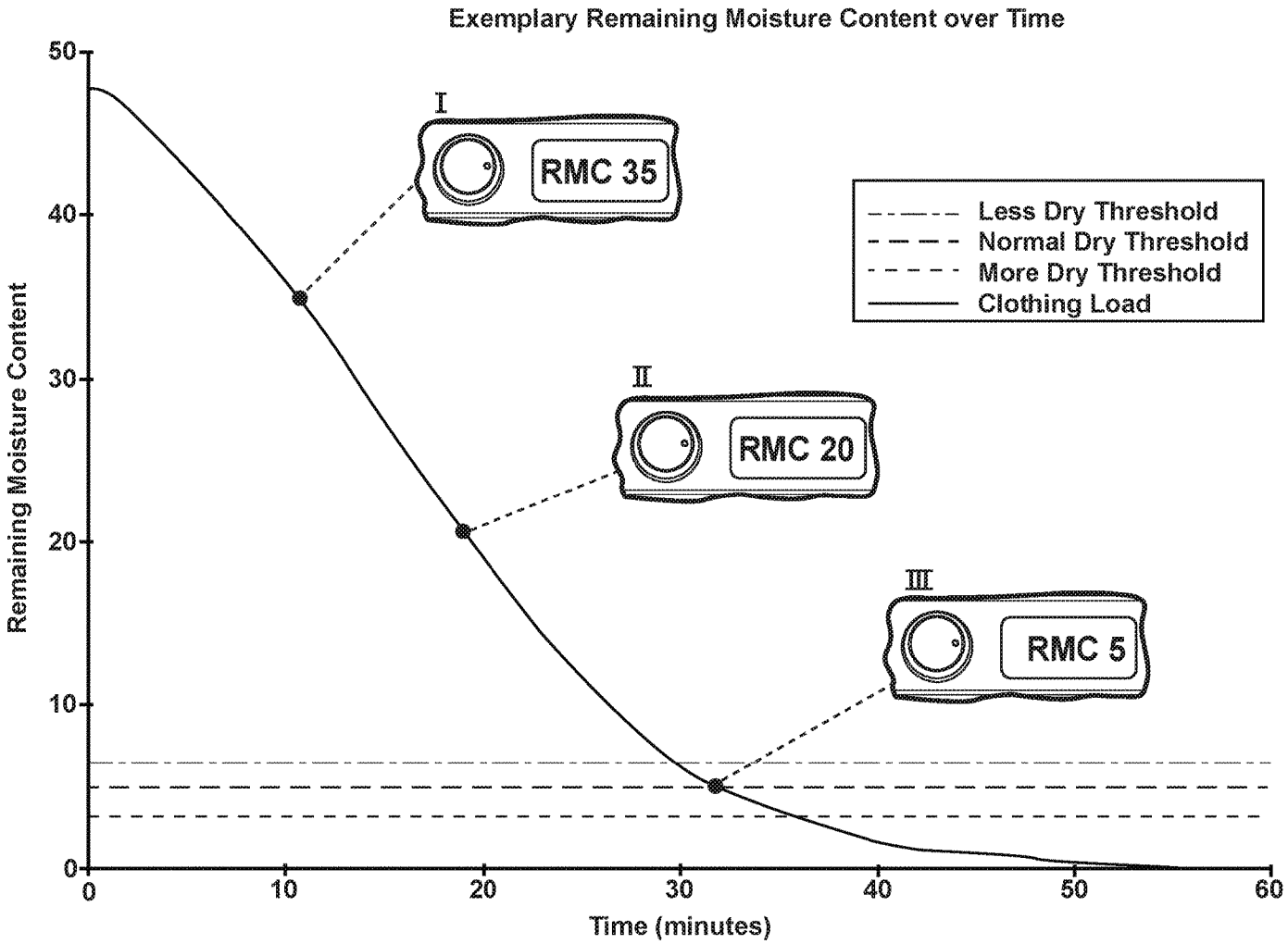
FIG. 3A is a graph showing an estimated remaining moisture content of an exemplary load of fabric in a clothes dryer and corresponding display images at specific points over time.

Referring now to FIG. 3A, a graph plotting an exemplary remaining moisture content versus time of the load of fabric running in the clothes dryer 10 is displayed. The remaining moisture content data is collected through one or more sensors 54 and one or more internal physics modules where an algorithm that is performed with respect to a load being dried updates the estimated remaining moisture content or water contained within the load of fabric. In some embodiments, sensing the remaining moisture content in the clothes dryer 10 includes the use of one or more sensors 54 and/or one or more physics modules. Physics modules are disclosed in commonly assigned U.S. Pat. No. 9,341,411, entitled "METHOD FOR DETECTING THE CYCLE TERMINATION OF A HOUSEHOLD TUMBLE DRYER," the entire contents of which are incorporated herein by reference. The remaining moisture content is then updated in real time and is able to be visually displayed on the display 22 of the control panel 18 or other user interface. The real time display of the remaining moisture content allows the user to more reliably read and understand how close the drying cycle is to being finished. In some embodiments, displaying the remaining moisture content includes continually updating a real time remaining moisture content during the drying cycle.

Figure 3B:
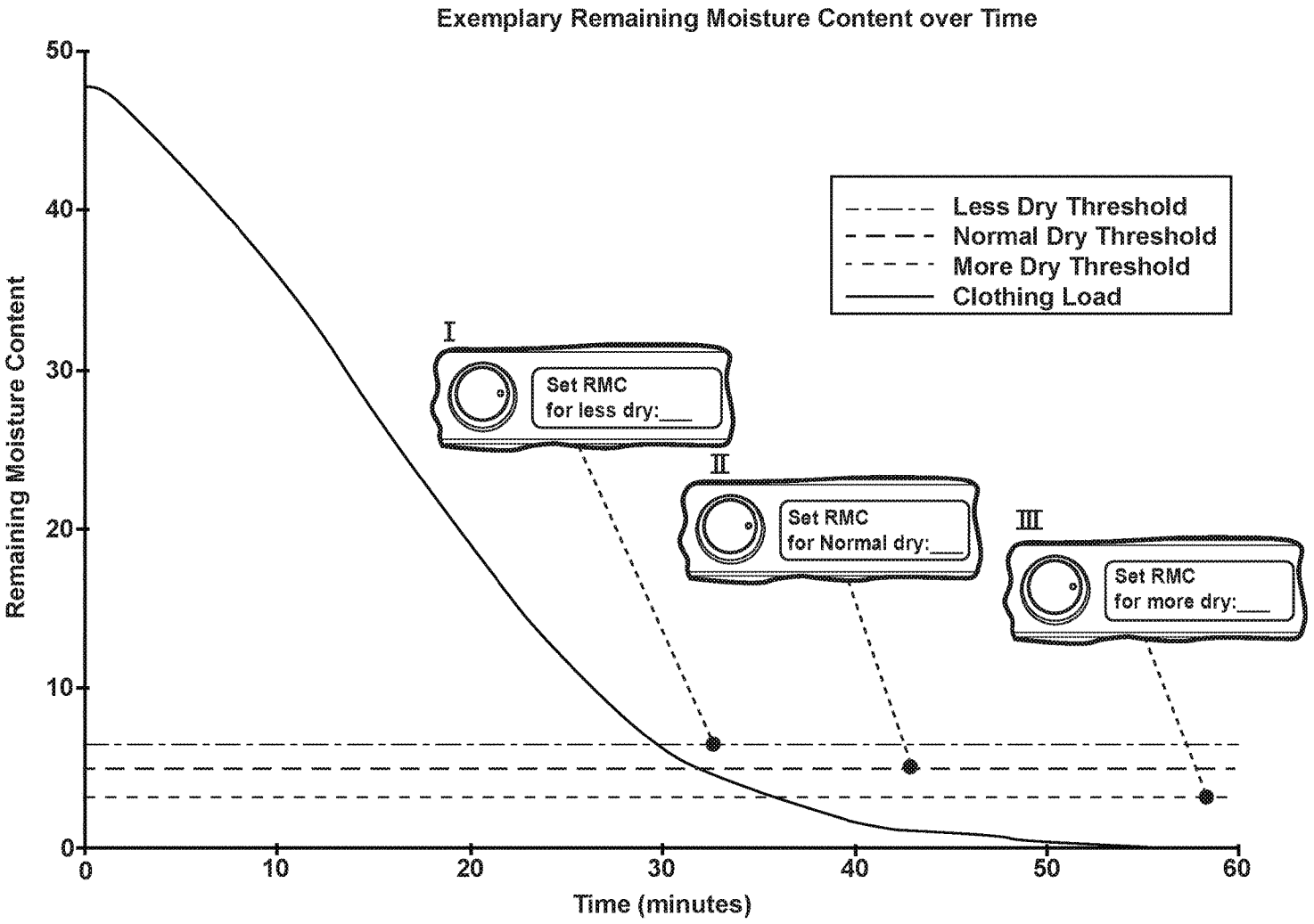
FIG. 3B is a graph showing an estimated remaining moisture content of an exemplary load of fabric in a clothes dryer and corresponding display images storing the target remaining moisture content for different dry levels of a drying cycle.

Referring now to FIG. 3B, both the sensing and display of the remaining moisture content of the load of fabric allows the user to adjust the preset dryness levels of the current load, and of future loads, to best fit their personal needs. In some embodiments, the one or more preset dryness levels are customizable by storing the target remaining moisture content for each of the preset dryness levels in response to user input. The user may customize, to their personal preferences, the final target remaining moisture content of any load of fabric the user intends to dry as shown in images (I-III).

Figure 4:
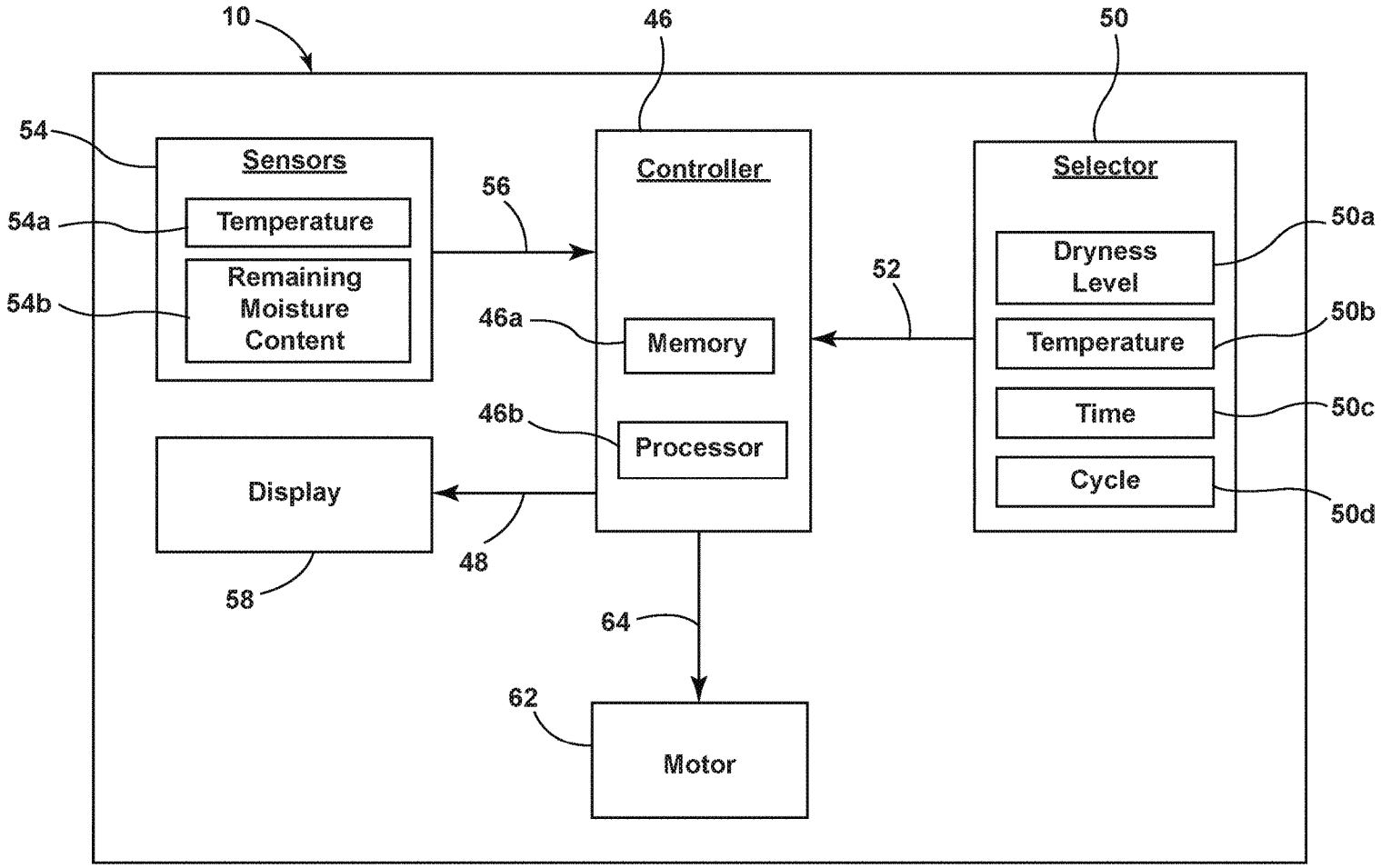
FIG. 4 is a schematic flow diagram of a controller in a clothes dryer according to one aspect of the present disclosure.

Referring now to FIG. 4, a schematic flow diagram of the controller 46 in communication with one or more selectors 50, one or more sensors 54, the motor 42, and the display 22 is shown for the clothes dryer 10. The controller 46 includes a memory 46*a* which stores instructions executable by a processor 46*b*. The controller 46 additionally receives input/information about the drying cycle 52 from a selector 50 where the selector 50 can include the programmable dryness level selector 50*a*, a temperature selector 50*b*, a time selector 50*c*, and a cycle selector 50*d*. Upon selecting the desired parameters to be factored into the performance of the drying cycle 52, the selector 50 sends the input/information concerning the drying cycle 52 to the controller 46 where the processor 46*b* controls the dryer 10 to perform the parameters of the drying cycle 52. The controller 46 additionally receives input/information related to the environmental conditions 56 within the drum 30 from the one or more sensors 54. Some non-limiting examples of sensors 54 that may be used in the clothes dryer 10 are one or more temperature sensors 54*a*, one or more remaining moisture content sensors 54*b*, and others. The sensors 54 detect a desired parameter of the environmental conditions 56 and send the corresponding input/information concerning the environmental conditions 56 to the controller 46 where the processor 46*b* derives the remaining moisture content and then sends the appropriate information concerning the remaining moisture content 48 to the display 22 where the information 48 is visually presented to the user. When the sensors 54 send the appropriate signal 56 to the controller 46 indicating the drying cycle is complete, the controller 46 will send a command signal 64 to the motor 62 to stop the drying cycle.

To enable additional means of communications between the user and the clothes dryer 10, a receiver (not shown) may be additionally coupled to the controller 46 to receive and transmit information obtained from Wi-Fi signals, microwave signals, radio signals, infrared signals, Bluetooth signals, and/or satellite signals. In some embodiments, the controller 46 is configured to receive input from a portable electronic device to change the stored target remaining moisture content for the preset dryness level. The portable electronic device is not meant to be limiting and may include, for example, cellphones, tablets, remote controls, and/or laptop computers.

The display 22 can be any one of various display types. In some embodiments, the display 22 may be a 7-segment display and in other embodiments the display 22 may be a liquid crystalline display (LCD display). The display 22 may be positioned in the cabinet 14 of the clothes dryer 10 to appear as part of the control panel 18 or surface of the cabinet 14. In other examples, the display 22 may extend out away from the cabinet 14 of the clothes dryer 10 to be visible by the user. Using the display 22, the remaining moisture content presented by the display 22 represents a real time remaining moisture content that is continually updated during performance of the drying cycle. In other embodiments, the display 22 may simultaneously display the real time remaining moisture content and an estimated time remaining for the drying cycle to the user based upon the remaining moisture content in conjunction with the parameters of the drying cycle 52.

Figure 5:
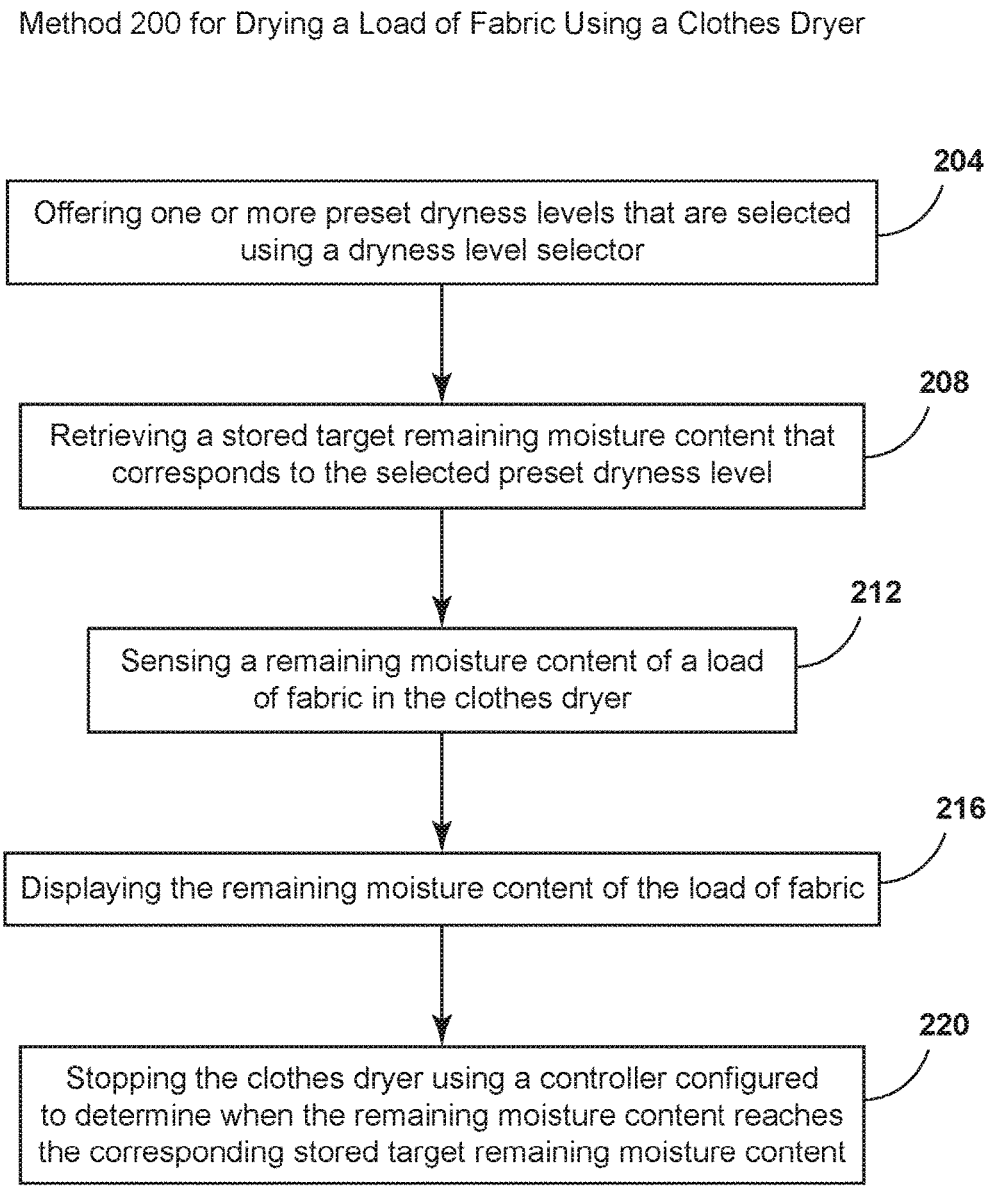
FIG. 5 is a schematic flow diagram illustrating a method for drying a load of fabric using a clothes dryer according to one aspect of the present disclosure.

Referring now to FIG. 5, having described the various embodiments of the clothes dryer 10 and the controller 46, a method 200 is disclosed for drying the load of fabric using the clothes dryer 10. According to method 200, the clothes dryer 10 is offered having one or more preset dryness levels that are selected using the programmable dryness level selector (step 204). The stored target remaining moisture content for the selected preset dryness level is retrieved and/or monitored for the respective drying cycle (step 208). As discussed above, the remaining moisture content of the load of fabric is sensed in the clothes dryer using one or more sensors 54 coupled to the controller 46 (step 212). As the drying cycle is operated, the remaining moisture content of the load of fabric is continually updated and is displayed in real time on the display (step 216). The clothes dryer 10 is stopped using the controller 46, which is configured to determine when the remaining moisture content reaches the stored remaining moisture content of the selected preset dryness level (step 220). When the remaining moisture content and the target remaining moisture content values are equal or approximately equal, the controller 46 is adapted to stop the drying cycle 52.

The programmable dryness level selector may be a dial, a button, a switch, or a menu option that allows the user to choose between the one or more preset dryness levels. In some embodiments, the programmable dryness level selector is used to select the desired preset dryness level that may be presented as a drying cycle, for example, a normal cycle, a delicate cycle, a casual cycle, or a permanent press cycle. In other embodiments, the programmable dryness level selector may display the stored remaining moisture content for each selected preset dryness level. As shown in FIG. 3B images I-III, this stored remaining moisture content may be visually displayed to the user and can then be selected and changed to the desired remaining moisture content by the user.

Figure 6:
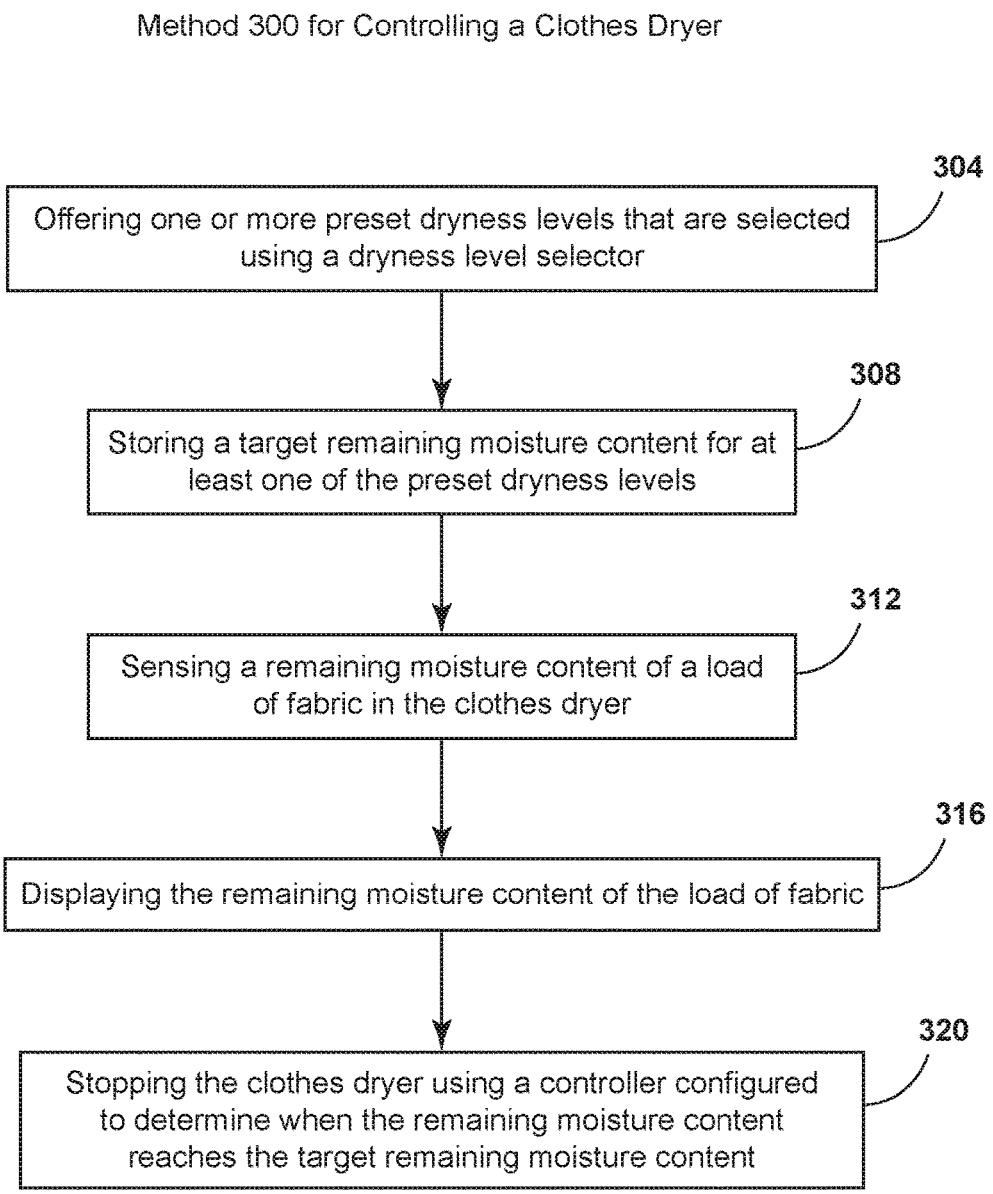
FIG. 6 is a schematic flow diagram illustrating a method for controlling a clothes dryer according to one aspect of the present disclosure.

Referring now to FIG. 6, having described the various embodiments of the clothes dryer 10 and the controller 46, a method 300 is disclosed for controlling the clothes dryer 10. According to method 300, the clothes dryer 10 is offered having one or more preset dryness levels that are selected using the programmable dryness level selector (step 304). The target remaining moisture content is stored for at least one of the preset dryness levels as desired by the user (step 308). As discussed above, the remaining moisture content of the load of fabric is sensed in the clothes dryer 10 using one or more sensors 54 coupled to the controller 46 (step 312). As the drying cycle is operated, the remaining moisture content of the load of fabric is continuously measured and is displayed in real time within the display 22 (step 316). The clothes dryer 10 is stopped using the controller 46 configured to determine when the remaining moisture content reaches the stored target remaining moisture content of the selected preset dryness level (step 320).

Figure 7:
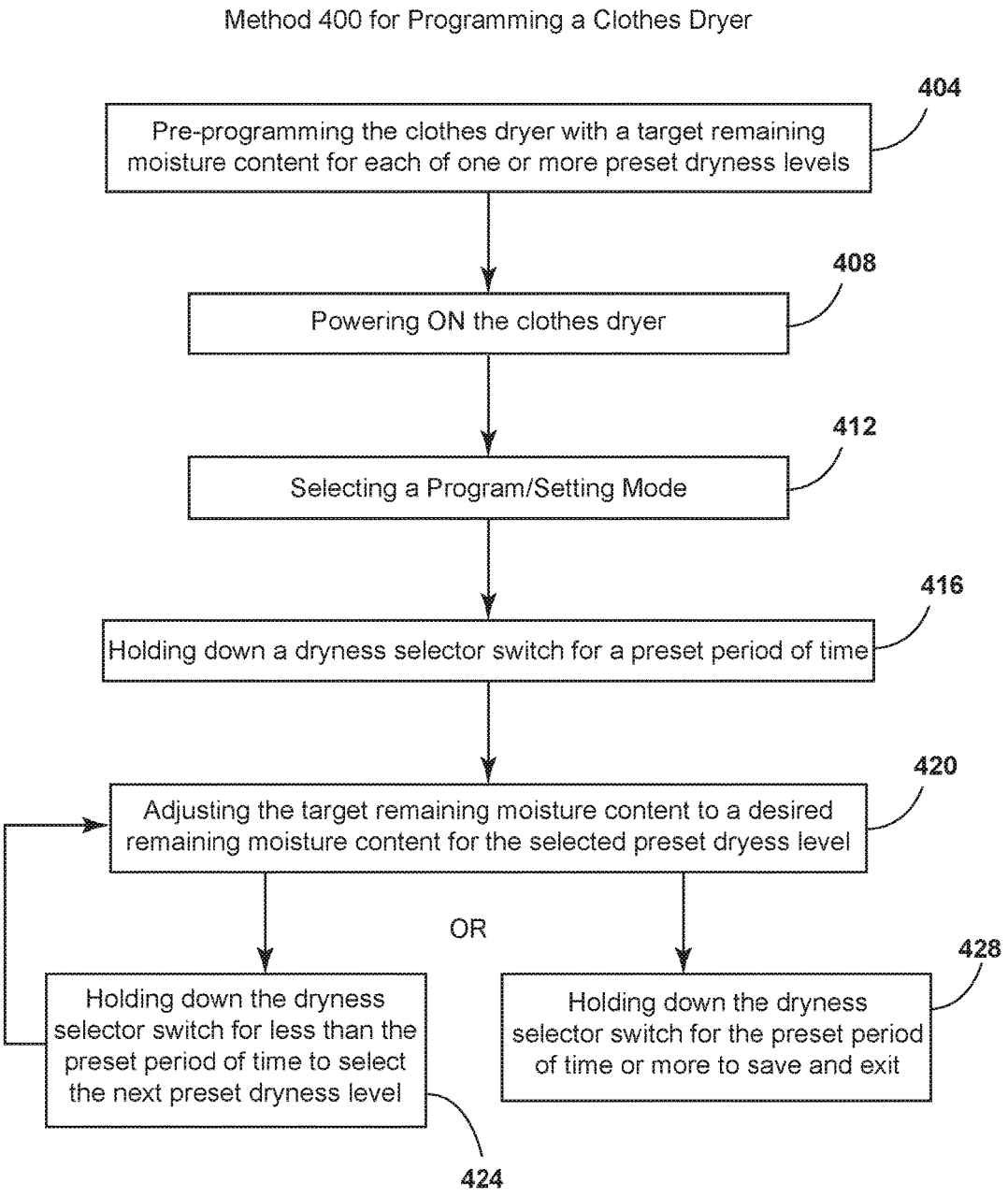
FIG. 7 is a schematic flow diagram illustrating a method for programming a clothes dryer according to one aspect of the present disclosure.

Referring now to FIG. 7, a method 400 is disclosed for programming the clothes dryer 10. The method includes the steps of pre-programming the clothes dryer 10 with the target remaining moisture content for each of the one or more preset dryness levels (step 404). This first pre-programming step can refer to the stock settings the manufacturer loads or installs with each of the respective drying cycles. The method 400 further includes powering on the clothes dryer (step 408) and then selecting a program/custom mode as shown in FIG. 1 (step 412). The user may then engage the programmable dryness selector switch (step 416) to then begin adjusting the target remaining moisture content to the desired remaining moisture content for the selected preset dryness level (step 420). As discussed previously, the selector can be any one of various selection interfaces that can include, but are not limited to, the display 22, knobs, dials, buttons, sliders, touch screens, and combinations thereof or other similar user interface mechanisms. As an example user interface, the user can engage a button and hold down the button for a preset period of time. The length of the "hold down" can be used to either make a selection, change the selection, modify the parameter, or perform other selection functions. The method further includes engaging the programmable dryness selector to select the next preset dryness level (step 424). If the user selects the next preset dryness level (step 424), the user would then repeat the adjusting step by adjusting the target remaining moisture content to the desired remaining moisture content for the newly selected preset dryness level (step 420). After the user has stored the desired target remaining moisture content for each of the desired preset dryness levels, the user can engage the programmable dryness selector to save and exit (step 428).

To meet and qualify for certain energy standards and criteria, such as those of the Consumer Union (CU), manufacturers may pre-program the clothes dryer 10 with target remaining moisture contents to achieve various testing scores. For example, a given drying cycle with a less dry setting may be set with a higher percent target remaining moisture content while the same cycle with a more dry setting may be set with a lower percent target remaining moisture content. Each of the cycles and/or dryness levels, including those not tested by the CU, may have a default remaining moisture content setting of any desired remaining moisture content percentage.

Figure 8:
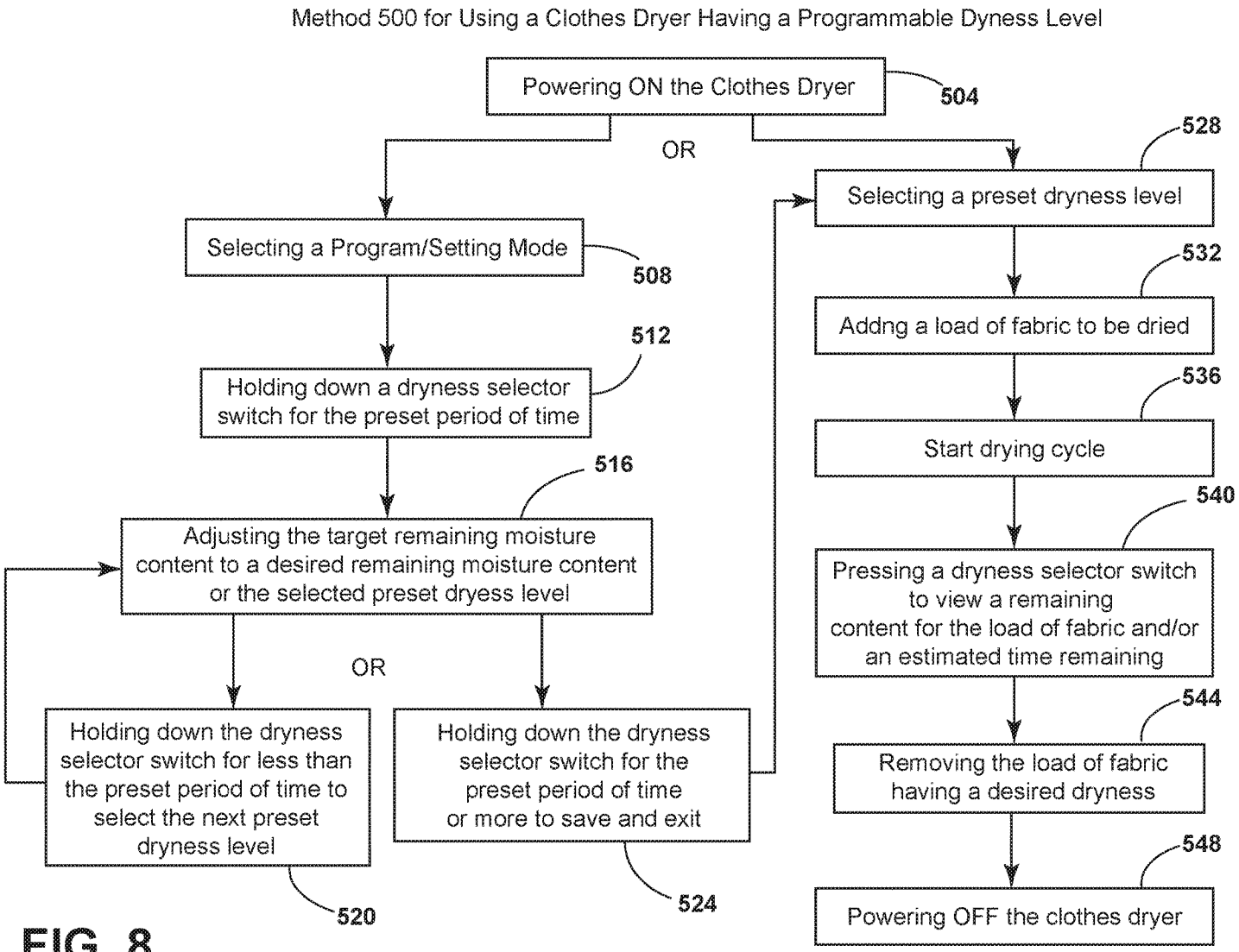
FIG. 8 is a schematic flow diagram illustrating a method for using a clothes dryer having a programmable dryness level.

Referring now to FIG. 8, a method 500 is disclosed for using the clothes dryer 10 having a programmable dryness level. The method includes powering on the clothes dryer 10 (step 504) and selecting a program/custom mode as shown in FIG. 1 (step 508). The user may then engage the programmable dryness selector (step 512) to adjust the target remaining moisture content to the desired remaining moisture content for the given selected preset dryness level as shown in FIG. 3B images I-Ill (step 516). The method 500 further includes the user engaging the programmable dryness selector to select a different preset dryness level (step 520). If the user selects the next preset dryness level (step 520), the user would then repeat the adjusting step by adjusting the target remaining moisture content to the desired remaining moisture content for the newly selected preset dryness level (step 516). After the user has stored the target remaining moisture content for each of the desired preset dryness levels, the user can engage the programmable dryness selector again to save and exit (step 524).

Once the portion of the method 500 relating to programming the preset dryness levels is completed, the method 500 further includes selecting one of the preset dryness levels (step 528) and adding the load of fabric to be dried (step 532). The user may then start the drying cycle (step 536) and may engage the programmable dryness selector to view the remaining moisture content for the load of fabric (step 540). The user may again engage the dryness selector to view on the display 22, which can display the remaining moisture content and/or an estimated time remaining (step 540). The user may choose to view or change views between the remaining moisture content for the load of fabric and the estimated time remaining at any time. The method 500 further includes removing the load of fabric having a desired dryness (step 544) and powering off the clothes dryer (548).

It will be understood by one having ordinary skill in the art that construction of the described device and other components is not limited to any specific material. Other exemplary embodiments of the device disclosed herein may be formed from a wide variety of materials, unless described otherwise herein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method of drying a load of fabric using a clothes dryer, the method comprising:

offering one or more preset dryness levels that are selectable using a programmable dryness level selector to establish a drying cycle;

selecting one of the one or more preset dryness levels using the programmable dryness level selector to define a selected preset dryness level;

retrieving a stored target remaining moisture content that corresponds to the selected preset dryness level;

customizing the selected preset dryness level by changing the stored target remaining moisture content corresponding to the selected preset dryness level to a desired remaining moisture content in response to user input wherein the desired remaining moisture content is different than the stored target remaining moisture content;

sensing a remaining moisture content of the load of fabric in the clothes dryer; and automatically stopping the clothes dryer using a controller configured to determine when the remaining moisture content of the load of fabric reaches the corresponding stored target remaining moisture content.

2. The method of claim 1, further comprising a step of:

displaying the remaining moisture content of the load of fabric.

3. The method of claim 1, wherein sensing the remaining moisture content comprises using one or more sensors with one or more physics modules.

4. The method of claim 2, wherein displaying the remaining moisture content includes continually updating a real time remaining moisture content during the drying cycle.

5. The method of claim 2, wherein the step of displaying the remaining moisture content includes simultaneously displaying an estimated time remaining for the drying cycle.

6. The method of claim 1, further comprising a step of:

receiving user input from a portable electronic device by the controller to change the stored target remaining moisture content corresponding to the selected preset dryness level to the desired remaining moisture content.

7. The method of claim 1, further comprising a step of:

displaying the stored target remaining moisture content for each selected preset dryness level with the programmable dryness level selector.

8. A method of controlling a clothes dryer, the method comprising:

offering one or more preset dryness levels that are selectable using a programmable dryness level selector to establish a drying cycle;

selecting one of the one or more preset dryness levels using the programmable dryness level selector to define a selected preset dryness level;

retrieving a stored target remaining moisture content that corresponds to the selected preset dryness level;

customizing the selected preset dryness level by changing the stored target remaining moisture content corresponding to the selected preset dryness level to a desired remaining moisture content in response to user input wherein the desired remaining moisture content is different than the stored target remaining moisture content;

saving the desired remaining moisture content as the stored target remaining moisture content to correspond to the selected preset dryness level;

sensing a remaining moisture content of a load of fabric in the clothes dryer;

and automatically stopping the clothes dryer using a controller configured to determine when the remaining moisture content of the load of fabric reaches the corresponding stored target remaining moisture content.

9. The method of claim 8, wherein sensing the remaining moisture content comprises using one or more sensors.

10. The method of claim 8, further comprising displaying the remaining moisture content of the load of fabric wherein displaying the remaining moisture content includes continually updating a real time remaining moisture content during the drying cycle.

11. The method of claim 8 further comprising a step of:

displaying an estimated time remaining for the drying cycle.

12. The method of claim 8, further comprising a step of:

receiving user input from a portable electronic device by the controller to change the stored target remaining moisture content corresponding to the selected preset dryness level.

13. The method of claim 8, further comprising a step of:

displaying the stored target remaining moisture content for each selected preset dryness level with the programmable dryness level selector.

14. The method of claim 8, wherein the programmable dryness level selector has more than one preset dryness level with a user-modifiable stored target remaining moisture content.

15. A clothes dryer comprising:

a cabinet;

a drum rotatably mounted within the cabinet for receiving a load of fabric to be dried;

a display adapted to present a real time remaining moisture content for the load of fabric;

a controller configured to receive information from one or more sensors and a selector to determine a length of time for a drying cycle; and a control panel coupled to the cabinet; wherein the selector comprises a programmable dryness level selector with one or more preset dryness levels, the one or more preset dryness levels each having a corresponding user-modifiable stored target remaining moisture content.

16. The clothes dryer of claim 15, further comprising:

one or more sensors and/or one or more physics modules to sense the real time remaining moisture content for the load of fabric.

17. The clothes dryer of claim 15, wherein the display simultaneously presents an estimated time remaining for the drying cycle.

18. The clothes dryer of claim 15, wherein the programmable dryness level selector displays a stored target remaining moisture content for each preset dryness level.

19. The clothes dryer of claim 15, wherein the programmable dryness level selector has more than one dryness level that can be preset with a stored target remaining moisture content.

20. The clothes dryer of claim 15, wherein the controller is configured to receive input from a portable electronic device to change the length of time for the drying cycle.

* * * * *